US007942764B2

(12) United States Patent
Chung

(10) Patent No.: US 7,942,764 B2
(45) Date of Patent: May 17, 2011

(54) BASEBALL BAT

(76) Inventor: Min-Ju Chung, Taichung Hsien (TW)

( * ) Notice: Subject to any disclaimer, the term of this patent is extended or adjusted under 35 U.S.C. 154(b) by 87 days.

(21) Appl. No.: 12/578,802

(22) Filed: Oct. 14, 2009

(65) Prior Publication Data

US 2011/0086734 A1 Apr. 14, 2011

(51) Int. Cl.
*A63B 59/06* (2006.01)

(52) U.S. Cl. ..... 473/564; 473/566; 473/567

(58) Field of Classification Search ..... 473/457, 473/519, 520, 564–568
See application file for complete search history.

(56) References Cited

U.S. PATENT DOCUMENTS

| | | | | |
|---|---|---|---|---|
| 3,877,698 | A * | 4/1975 | Volpe | 473/520 |
| 4,323,239 | A * | 4/1982 | Ishii | 473/566 |
| 5,219,164 | A * | 6/1993 | Peng | 473/520 |
| 5,409,214 | A * | 4/1995 | Cook | 473/564 |
| 5,593,158 | A * | 1/1997 | Filice et al. | 473/520 |
| 6,099,422 | A * | 8/2000 | Rappaport et al. | 473/567 |
| 6,432,006 | B1 * | 8/2002 | Tribble | 473/564 |
| 6,511,392 | B1 * | 1/2003 | Chohan | 473/564 |
| 6,609,984 | B1 * | 8/2003 | Tribble | 473/564 |
| 6,758,771 | B2 * | 7/2004 | Tribble | 473/564 |
| 6,783,471 | B2 * | 8/2004 | Bolduc et al. | 473/457 |
| 6,824,482 | B1 * | 11/2004 | Tribble | 473/564 |
| 7,140,988 | B1 * | 11/2006 | Hinman | 473/566 |
| 7,166,046 | B1 * | 1/2007 | Liu | 473/567 |
| 7,261,654 | B2 * | 8/2007 | Cheng | 473/457 |
| 7,311,620 | B1 * | 12/2007 | Heald et al. | 473/566 |
| 7,381,141 | B2 * | 6/2008 | Van Nguyen | 473/566 |
| 7,419,446 | B2 * | 9/2008 | Nguyen | 473/567 |
| 7,572,197 | B2 * | 8/2009 | Chauvin et al. | 473/567 |
| 7,601,083 | B1 * | 10/2009 | Heald et al. | 473/566 |
| 7,798,926 | B1 * | 9/2010 | Hsu | 473/566 |
| 2004/0224803 | A1 * | 11/2004 | Forsythe et al. | 473/564 |
| 2005/0277497 | A1 * | 12/2005 | Chang | 473/567 |
| 2005/0288130 | A1 * | 12/2005 | Lefebvre et al. | 473/457 |
| 2006/0252586 | A1 * | 11/2006 | Nguyen | 473/564 |
| 2006/0293129 | A1 * | 12/2006 | Kobayashi | 473/564 |
| 2006/0293130 | A1 * | 12/2006 | Guenther et al. | 473/564 |
| 2007/0191156 | A1 * | 8/2007 | Van Nguyen | 473/564 |
| 2009/0264230 | A1 * | 10/2009 | Thouin | 473/567 |
| 2010/0113194 | A1 * | 5/2010 | Tokieda | 473/566 |
| 2010/0125014 | A1 * | 5/2010 | Watari et al. | 473/566 |

* cited by examiner

*Primary Examiner* — Mark S Graham
(74) *Attorney, Agent, or Firm* — Whyte Hirschboeck Dudek S.C.

(57) ABSTRACT

A baseball bat includes a hollow grip member having opposite front and rear ends, and an inner peripheral surface that defines a tapered chamber having a diameter reducing gradually toward the rear end. The inner peripheral surface has a first positioning portion disposed between the front end and the rear end. A striking member has an engaging segment received in the tapered chamber, and a large diameter segment extending forwardly from the engaging segment. The engaging segment has an axial hole, a plurality of open-ended slits extending along an axial direction and in spatial communication with the axial hole, and a second positioning portion aligned with the first positioning portion. A pressing member is inserted into the axial hole to press the second positioning portion against the first positioning portion.

9 Claims, 6 Drawing Sheets

BASEBALL BAT

BACKGROUND OF THE INVENTION

1. Field of the Invention

The invention relates to an exercise instrument, more particularly to a baseball bat.

2. Description of the Related Art

As shown in FIG. 1, a conventional baseball bat disclosed in U.S. Pat. No. 5,409,214 comprises a hollow grip member 1, a striking member 2, a bat filler 3, and an anti-slip layer 4 disposed at an outer surface of the hollow grip member 1. The hollow grip member 1 has a tapered chamber 101. The striking member 2 has a tapered segment 201 disposed in the tapered chamber 101 and a large diameter segment 202 extending forwardly from the tapered segment 201 and having a diameter larger than a maximum diameter of the tapered segment 201. The filler 3 has a portion disposed in the tapered chamber 101 and between the hollow grip member 1 and the tapered segment 201. An adhesive is applied between an inner peripheral surface of the hollow grip member 1 and an outer surface of the tapered segment 201, such that the hollow grip member 1 and the tapered segment 201 are connected fixedly to each other.

However, when a user swings the conventional baseball bat, the striking member 2 may accidently separate from the hollow grip member 1 due to lack of a locking device disposed therebetween.

SUMMARY OF THE INVENTION

Therefore, the object of the present invention is to provide a baseball bat capable of alleviating the above drawbacks of the prior art.

Accordingly, a baseball bat of the present invention comprises a hollow grip member having a front end, a rear end opposite to the front end along an axial direction, and an inner peripheral surface extending from the front end to the rear end. The inner peripheral surface defines a tapered chamber that has a diameter reducing gradually toward the rear end. The inner peripheral surface has a first positioning portion disposed between the front end and the rear end. A striking member has an engaging segment received in the tapered chamber, and a large diameter segment extending forwardly from the engaging segment and having a diameter larger than a maximum diameter of the engaging segment. The engaging segment has an axial hole extending along the axial direction, a plurality of open-ended slits extending along the axial direction and in spatial communication with the axial hole, and a second positioning portion aligned with the first positioning portion. A pressing member is inserted into the axial hole so as to press the second positioning portion against the first positioning portion, such that the first positioning portion is disposed in front of the second positioning portion.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
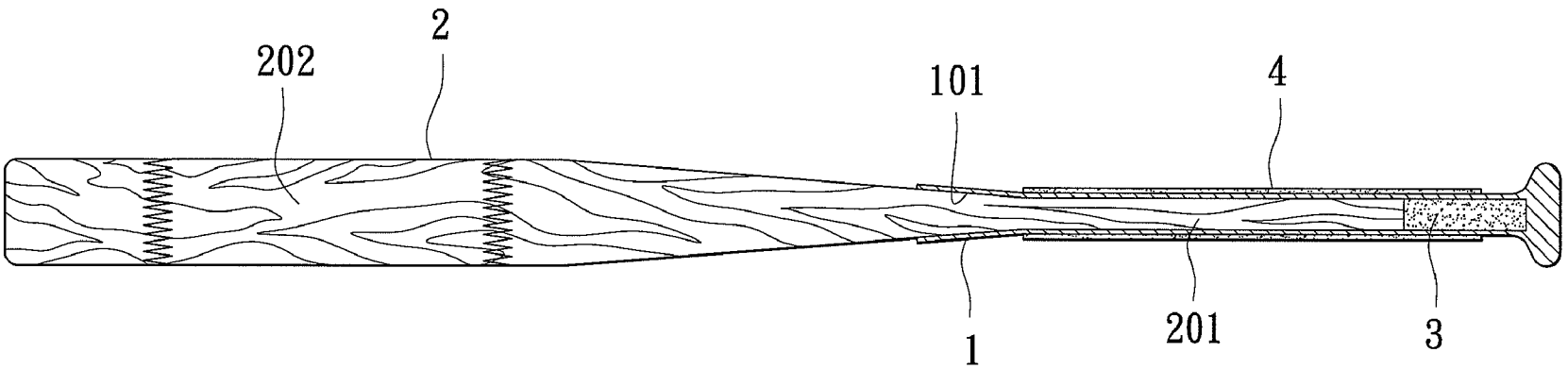
FIG. 1 PRIOR ART
FIG. 1 is a schematic sectional view of a conventional baseball bat disclosed in U.S. Pat. No. 5,409,214.
Figure 2:
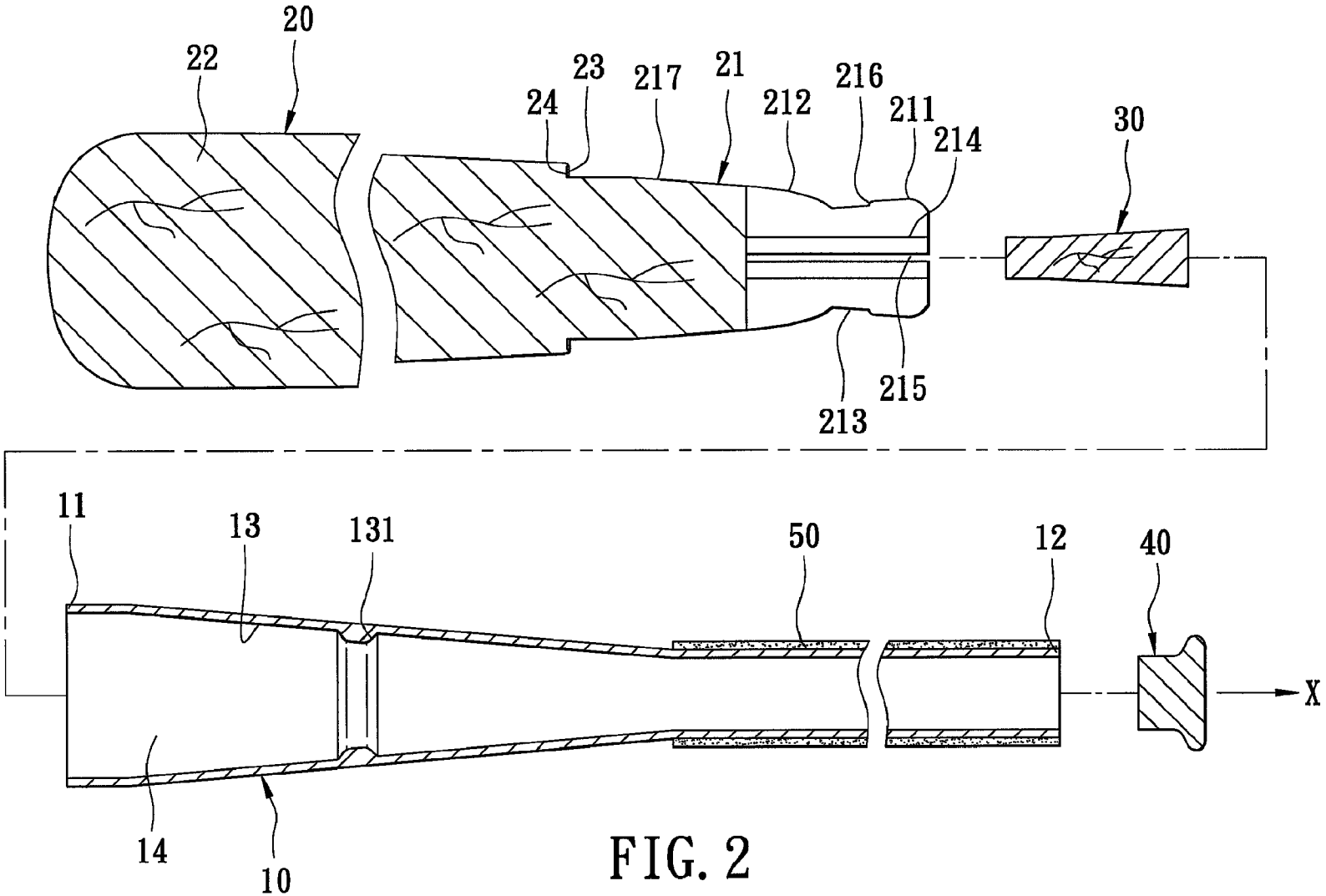
FIG. 2 is an exploded schematic sectional view of a preferred embodiment of a baseball bat according to the present invention.
Figure 3:
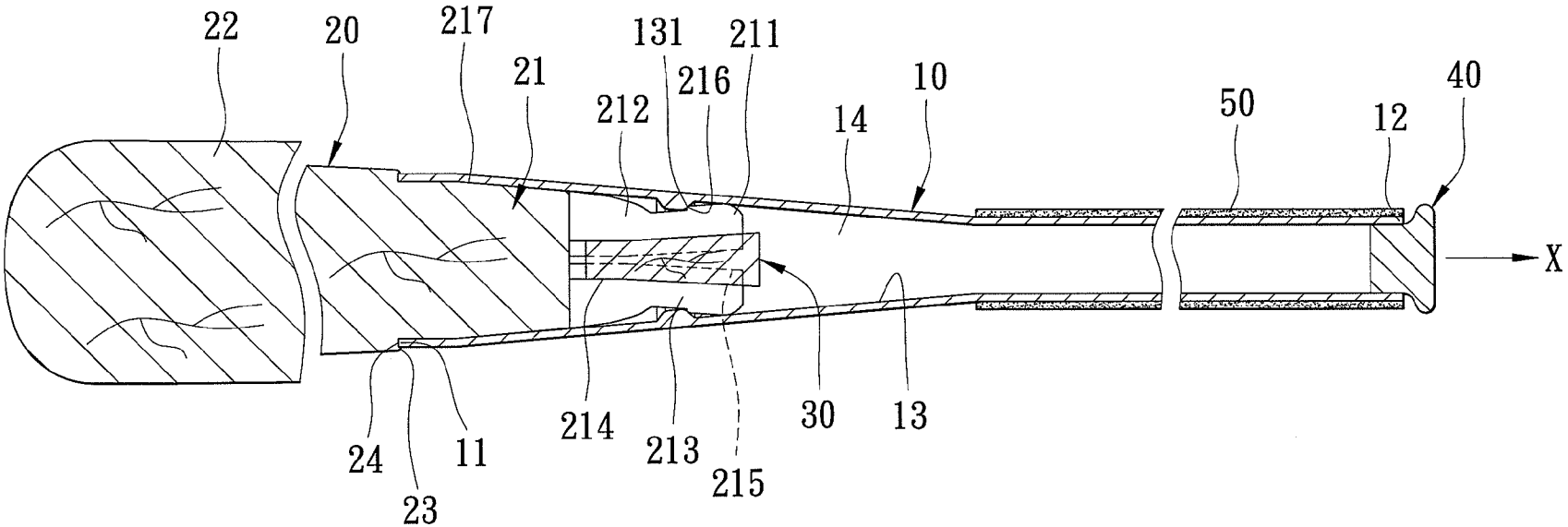
FIG. 3 is an assembled sectional view of the preferred embodiment.
Figure 4:
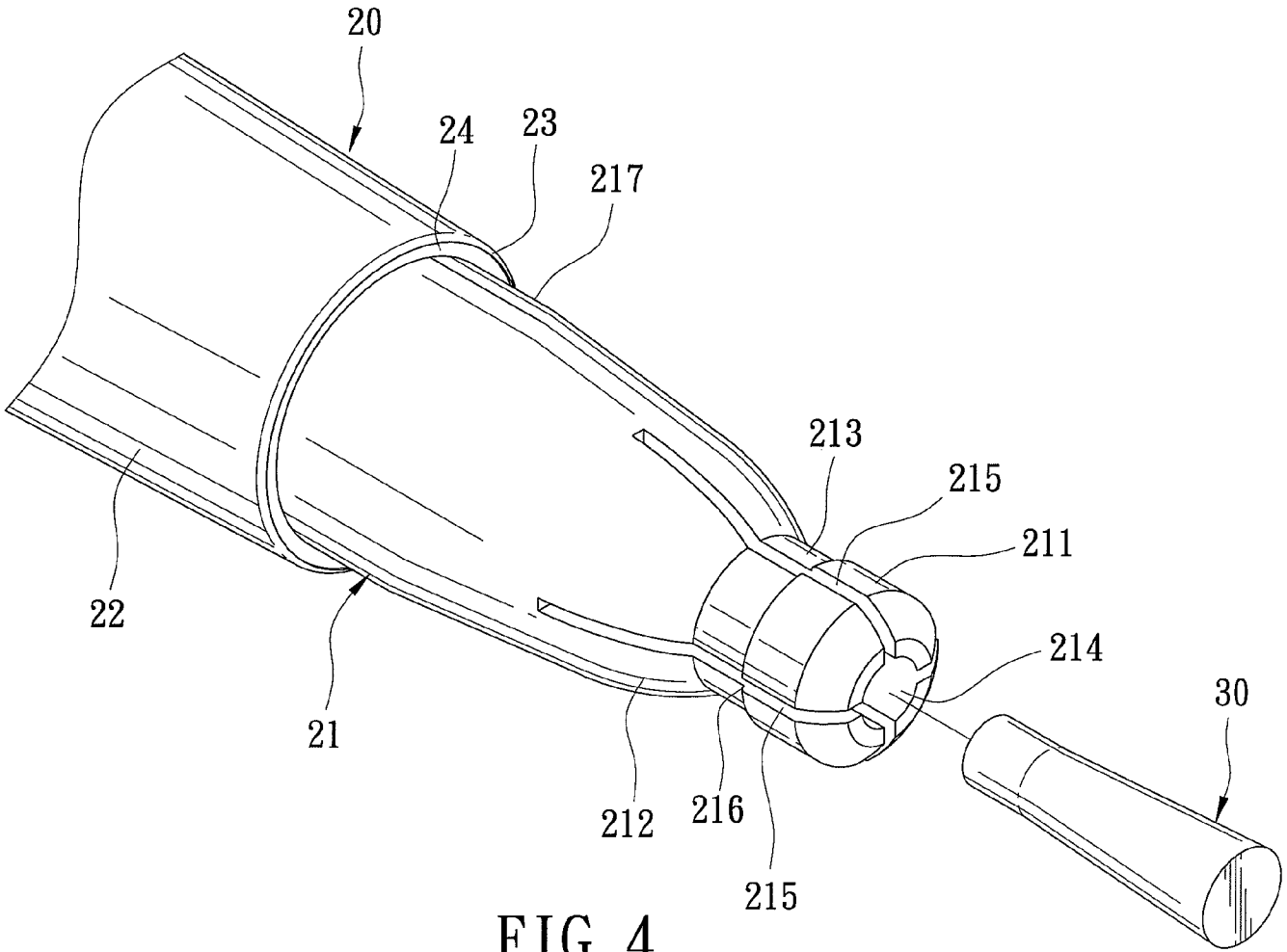
FIG. 4 is a fragmentary, partly exploded perspective view of the preferred embodiment.

As shown in FIGS. 2 to 4, a preferred embodiment of a baseball bat according to the present invention comprises a hollow grip member 10, a striking member 20, a pressing member 30, a plug 40, and an anti-slip layer 50.

The hollow grip member 10 has a front end 11, a rear end 12 opposite to the front end 11 along an axial direction (X), and an inner peripheral surface 13 extending from the front end 11 to the rear end 12. The inner peripheral surface 13 defines a tapered chamber 14 that has a diameter reducing gradually toward the rear end 12. The inner peripheral surface 13 has a first positioning portion 131 disposed between the front end 11 and the rear end 12. In this preferred embodiment, the hollow grip member 10 is made of a material selected from the group consisting of aluminum alloy, plastic, and carbon fiber composite material. The hollow grip member 10 is formed with an annular projection extending radially and inwardly from the inner peripheral surface 13 and constituting the first positioning portion 131.

The striking member 20 has an engaging segment 21 received in the tapered chamber 14, and a large diameter segment 22 extending forwardly from the engaging segment 21 and having a diameter larger than a maximum diameter of the engaging segment 21. The large diameter segment 22 of the striking member 20 has an annular rear end surface 23 formed with an annular groove 24. The front end 11 of the hollow grip member 10 is inserted into the annular groove 24 in the rear end surface 23 of the large diameter segment 22. The engaging segment 21 has an axial hole 214 extending along the axial direction (X), a plurality of open-ended slits 215 (only one is shown in FIGS. 2 and 3) extending along the axial direction (X) and in spatial communication with the axial hole 214, and a second positioning portion 216 aligned with the first positioning portion 131. The engaging segment 21 further has a tapered portion 217, a head portion 211 disposed at a rear end of the engaging segment 21, a front shoulder portion 212 connected to and disposed behind the tapered portion 217, and a neck portion 213 connected between the front shoulder portion 212 and the head portion 211 and having a maximum diameter smaller than a minimum diameter of the head portion 211 to define a rear shoulder between the neck portion 213 and the head portion 211. The rear shoulder constitutes the second positioning portion 216. In this preferred embodiment, the striking member 20 is made of wood.

The pressing member 30 is inserted into the axial hole 214 so as to press the second positioning portion 216 against the first positioning portion 131, such that the first positioning portion 131 is disposed in front of the second positioning portion 216. As such, the engaging segment 21 of the striking member 20 is locked within the hollow handle grip member 10. In this preferred embodiment, the pressing member 30 is made of a material selected from the group consisting of aluminum alloy, plastic, and carbon fiber composite material. The pressing member 30 has a diameter reducing gradually toward the front end 11 of the hollow grip member 10.

The plug 40 is press-fitted within the rear end 12 of the hollow grip member 10 and seals the tapered chamber 14. The anti-slip layer 50 is disposed on an outer peripheral surface of the grip member 10.

Figure 5:
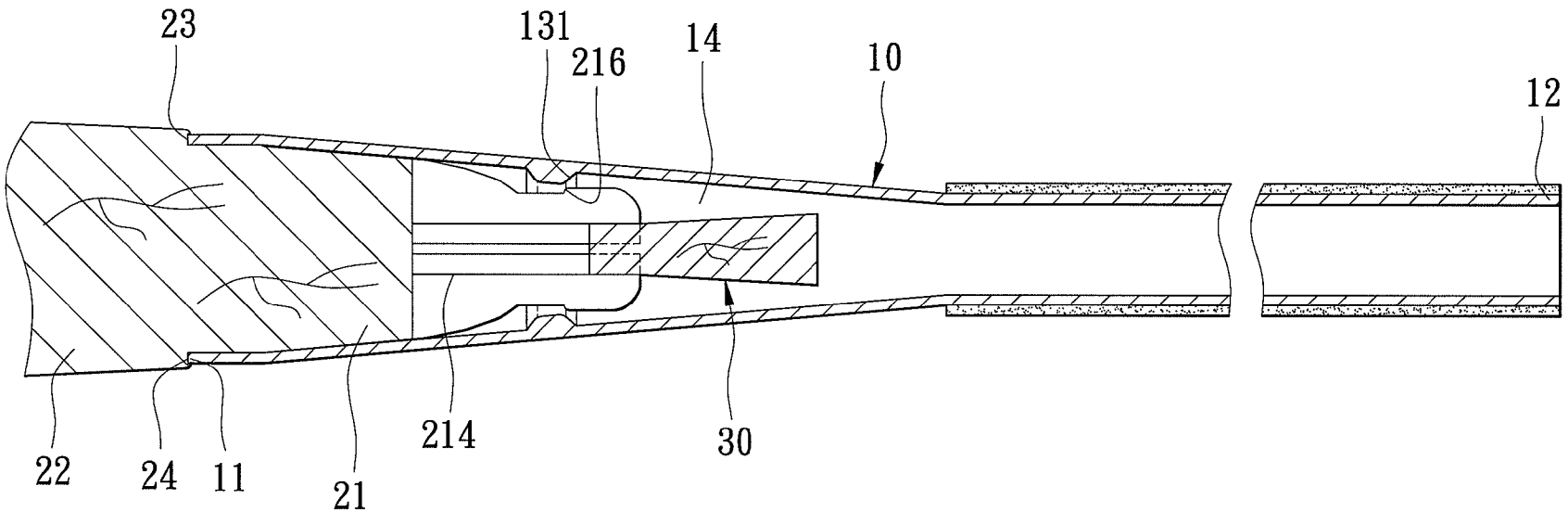
FIG. 5 is a fragmentary assembled schematic sectional view of the preferred embodiment, illustrating how an engaging segment of a striking member is inserted into a tapered chamber of a hollow grip member.
Figure 6:
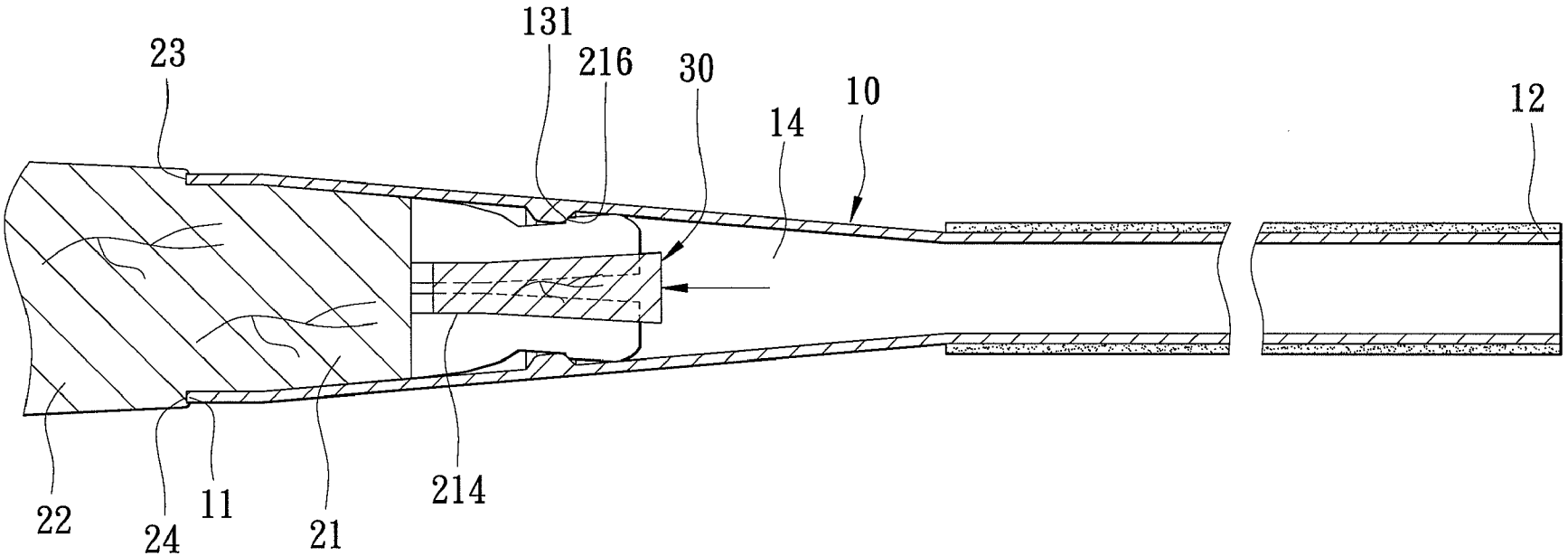
FIG. 6 is a fragmentary schematic sectional view of the preferred embodiment, illustrating how a pressing member is inserted into an axial hole of the engaging segment to lock the engaging segment of the striking member within the hollow grip member.

As shown in FIGS. 5 and 6, when it is desired to assemble the baseball bat, a front end of the pressing member 30 is first inserted into the axial hole 214 of the engaging segment 21, and the engaging segment 21 is inserted into the tapered chamber 14 such that the front end 11 of the hollow grip member 10 is inserted into the annular groove 24 in the rear end surface 23 of the large diameter segment 22. Afterwards, an impact device (not shown) is inserted into the tapered chamber 14 via the rear end 12 of the grip member 10 to move forwardly the pressing member 30 into the axial hole 214 (see FIG. 6), so that the second positioning portion 216 is pressed against the first positioning portion 131.

Consequently, since the first positioning portion 131 abuts against the second positioning portion 216, when a user swings the baseball bat, the striking member 20 is unlikely to separate from the hollow grip member 10.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A baseball bat comprising:

a hollow grip member having a front end, a rear end opposite to said front end along an axial direction, and an inner peripheral surface extending from said front end to said rear end, said inner peripheral surface defining a tapered chamber that has a diameter reducing gradually toward said rear end, said inner peripheral surface having a first positioning portion disposed between said front end and said rear end;

a striking member having an engaging segment received in said tapered chamber, and a large diameter segment extending forwardly from said engaging segment and having a diameter larger than a maximum diameter of said engaging segment, said engaging segment having an axial hole extending along the axial direction, a plurality of open-ended slits extending along the axial direction and in spatial communication with said axial hole, and a second positioning portion aligned with said first positioning portion; and a pressing member inserted into said axial hole so as to press said second positioning portion against said first positioning portion, such that said first positioning portion is disposed in front of said second positioning portion.

2. The baseball bat as claimed in claim 1, wherein said hollow grip member is formed with an annular projection extending radially and inwardly from said inner peripheral surface and constituting said first positioning portion, said engaging segment further having a tapered portion, a head portion disposed at a rear end of said engaging segment, a front shoulder portion connected to and disposed behind said tapered portion, and a neck portion connected between said front shoulder portion and said head portion and having a maximum diameter smaller than a minimum diameter of said head portion to define a rear shoulder between said neck portion and said head portion, said rear shoulder constituting said second positioning portion.

3. The baseball bat as claimed in claim 2, wherein said large diameter segment of said striking member has an annular rear end surface formed with an annular groove, said front end of said hollow grip member being inserted into said annular groove in said rear end surface of said large diameter segment.

4. The baseball bat as claimed in claim 3, wherein said hollow grip member has an open rear end, said baseball bat further comprising a plug that is press-fitted within said open rear end and that seals said tapered chamber.

5. The baseball bat as claimed in claim 4, further comprising an anti-slip layer disposed on an outer peripheral surface of said hollow grip member.

6. The baseball bat as claimed in claim 2, wherein said pressing member has a diameter reducing gradually toward said front end of said hollow grip member.

7. The baseball bat as claimed in claim 1, wherein said hollow grip member is made of a material selected from the group consisting of aluminum alloy, plastic, and carbon fiber composite material.

8. The baseball bat as claimed in claim 1, wherein said striking member is made of wood.

9. The baseball bat as claimed in claim 1, wherein said pressing member is made of a material selected from the group consisting of aluminum alloy, plastic, and carbon fiber composite material.

* * * * *